US006053426A

United States Patent [19]

Robinson et al.

[11] Patent Number: 6,053,426

[45] Date of Patent: Apr. 25, 2000

[54] APPARATUS FOR PAINTING AN ICE SURFACE OF RINK

[75] Inventors: Alfred James Robinson, Headingley; Mark E. Bourns, St. Francois Xavier, both of Canada

[73] Assignee: Lawrence Church & Dale R. Bourns, Dugald, Canada

[21] Appl. No.: 09/112,280

[22] Filed: Jul. 9, 1998

[51] Int. Cl.[7] ..... B05B 9/00; B05B 1/20

[52] U.S. Cl. ..... 239/127; 239/142; 239/168

[58] Field of Search ..... 118/323; 239/127, 239/167, 168, 172, 159, 142

[56] References Cited

U.S. PATENT DOCUMENTS

| | | | |
|---|---|---|---|
| 3,940,065 | 2/1976 | Ware et al. | 239/127 |
| 4,197,998 | 4/1980 | Jolly, Jr. | 118/323 |
| 4,725,004 | 2/1988 | Baran, Jr. | 239/172 |
| 5,310,115 | 5/1994 | Broyhill | 239/168 |
| 5,333,794 | 8/1994 | Haruch | 239/600 |
| 5,335,854 | 8/1994 | Seitz et al. | 239/127 |

*Primary Examiner*—James Hook
*Assistant Examiner*—Davis Hwu
*Attorney, Agent, or Firm*—Adrain D. Battison; Murray E. Thrift

[57] ABSTRACT

Apparatus for spraying an ice surface with a white paint comprises a trailer having a tank carried on the trailer, a pump and a boom having a plurality of spray nozzles. The tank has a large opening in the top for receiving bags of paint pigment. The pump is a high capacity pump which generates a flow rate significantly greater than necessary to supply the nozzles. The excess is returned to the tank through a jet mixing system including four arms each having a pair of jet nozzles. A mixing wand is also provided which receives mixed materials from the pump for the jet nozzle for stirring within the tank. The nozzles are closely spaced so as to generate an overlapping spray pattern. The nozzles generate a fine mist and are directed slightly upwardly and rearwardly.

13 Claims, 3 Drawing Sheets

APPARATUS FOR PAINTING AN ICE SURFACE OF RINK

BACKGROUND OF THE INVENTION

This invention relates to an apparatus for painting an ice surface of the rink.

It is well known that rink surfaces are painted white with a layer of paint within the ice thickness so as to provide a plain white background for any markings to be applied to the ice on top of the white surface. This gives the ice an attractive appearance and shows up the markings which are necessary for various sports.

The volume of paint which must be applied to the surface to obtain the necessary thickness of coat is relatively large so that in order to cover the whole of an ice surface can require as much as 100 gallons of mixed paint and water. In addition, a number of separate coats is generally required.

The paint is supplied in 20 kilogram bags and as many as 13 bags are required in a tank totalling 100 gallons. It will be appreciated that this is a significant quantity of material to be transported across the ice.

Up till now ice has been coated using individual spray jets supplied from a separate tank or a backpack system. Where the tank is located off the ice surface, it is necessary for lines to be carried across the ice pumping the mixture from the tank to the jet nozzle. These lines are of course cumbersome and relatively lengthy in view of the large surface to be covered. In addition the individual jets leave significant opportunity for variability in the thickness of the coating applied so that the actual applied amount can exceed the amount required thus increasing the paint used or can be less than that which is required leaving a poor quality finish.

SUMMARY OF THE INVENTION

It is one object of the present invention, therefore, to provide an improved apparatus for spray painting an ice surface.

According to one aspect of the invention there is provided an apparatus for painting an ice surface of a rink comprising:

a support frame arranged for transportation across the ice surface;

a tank mounted on the frame having an opening at a top wall for insertion of paint and water for mixture in the tank and a discharge opening at a bottom wall for extraction of mixed materials from the tank;

a pump having an inlet lying connected to the discharge opening for pumping the mixed materials;

a boom mounted on the frame transversely of the frame;

a plurality of spray nozzles mounted on the boom at spaced positions along the boom;

a pipe connected from an outlet of the pump to the spray nozzles for supplying the mixed materials to the spray nozzles;

an injection mixing return connected from an outlet opening of the pump for injecting mixed materials into the tank and arranged for remixing of the materials in the tank;

wherein the pump generates a pumped volume greater than that which can pass in total through the nozzles and wherein the excess mixed materials pumped by the pump is returned to the tank through the injection mixing return to maintain the materials mixed during spraying.

Preferably the nozzle capacity is small so that the majority of the mixed materials is returned to the tank.

Preferably the pump has a capacity so that it can pump per minute a volume approximately equal to the volume of the tank.

Preferably the injection mixing return comprises a plurality of arms extending from a return hub across a base wall of the tank, each arm having jet nozzles therein.

Preferably the jet nozzles are arranged at the ends of the arms generally at right angles to the arms.

Preferably there is provided a mixing wand for insertion into the tank through the opening, the wand having a pipe connected to the pump for receiving the mixed materials therefrom and a jet nozzle at a remote end of the wand and wherein there is provided a valve arrangement operable to control flow of mixed materials either to the boom or to the wand such that the wand can be used prior to spraying to effect mixing of the materials in the tank.

Preferably there is provided on the tank a receptacle for the wand.

Preferably the opening at the top wall of the tank is of the order of eighteen inches.

Preferably the opening at the top of the tank includes a screw in lid.

Preferably the nozzles are arranged with an angle of spray pattern relative to a spacing between the nozzles and relative to a distance travelled by the spray from the nozzles to the ice surface such that the spray patterns overlap.

Preferably the spray patterns overlap sufficiently to provide double coverage across the full width of the spray pattern.

Preferably the boom is arranged such that the nozzles generate a spray pattern which is directed substantially horizontally such that the mist of spray falls by gravity onto the ice surface.

Preferably the boom is arranged rearwardly of the tank and the spray nozzles are directed substantially horizontally rearwardly.

Preferably the spray nozzles are directed slightly upwardly.

According to a second aspect of the invention there is provided an apparatus for painting an ice surface of a rink comprising:

a support frame arranged for transportation across the ice surface;

a tank mounted on the frame having an opening at a top wall for insertion of paint and water for mixture in the tank and a discharge opening at a bottom wall for extraction of mixed materials from the tank;

a pump having an inlet lying connected to the discharge opening for pumping the mixed materials;

a boom mounted on the frame transversely of the frame;

a plurality of spray nozzles mounted on the boom at spaced positions along the boom;

a pipe connected from an outlet of the pump to the spray nozzles for supplying the mixed materials to the spray nozzles;

an injection mixing return connected from an outlet opening of the pump for injecting mixed materials into the tank and arranged for remixing of the materials in the tank;

and a mixing wand for insertion into the tank through the opening, the wand having a pipe connected to the pump for receiving the mixed materials therefrom and a jet nozzle at a remote end of the wand and wherein there is provided a valve arrangement operable to control flow of mixed materials either to the boom or to the wand such that the wand can be used prior to spraying to effect mixing of the materials in the tank.

According to a third aspect of the invention there is provided an apparatus for painting an ice surface of a rink comprising:

a support frame arranged for transportation across the ice surface;

a tank mounted on the frame having an opening at a top wall for insertion of paint and water for mixture in the tank and a discharge opening at a bottom wall for extraction of mixed materials from the tank;

a pump having an inlet lying connected to the discharge opening for pumping the mixed materials;

a boom mounted on the frame transversely of the frame;

a plurality of spray nozzles mounted on the boom at spaced positions along the boom;

a pipe connected from an outlet of the pump to the spray nozzles for supplying the mixed materials to the spray nozzles;

wherein the nozzles are arranged with an angle of spray pattern relative to a spacing between the nozzles and relative to a distance travelled by the spray from the nozzles to the ice surface such that the spray patterns overlap.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
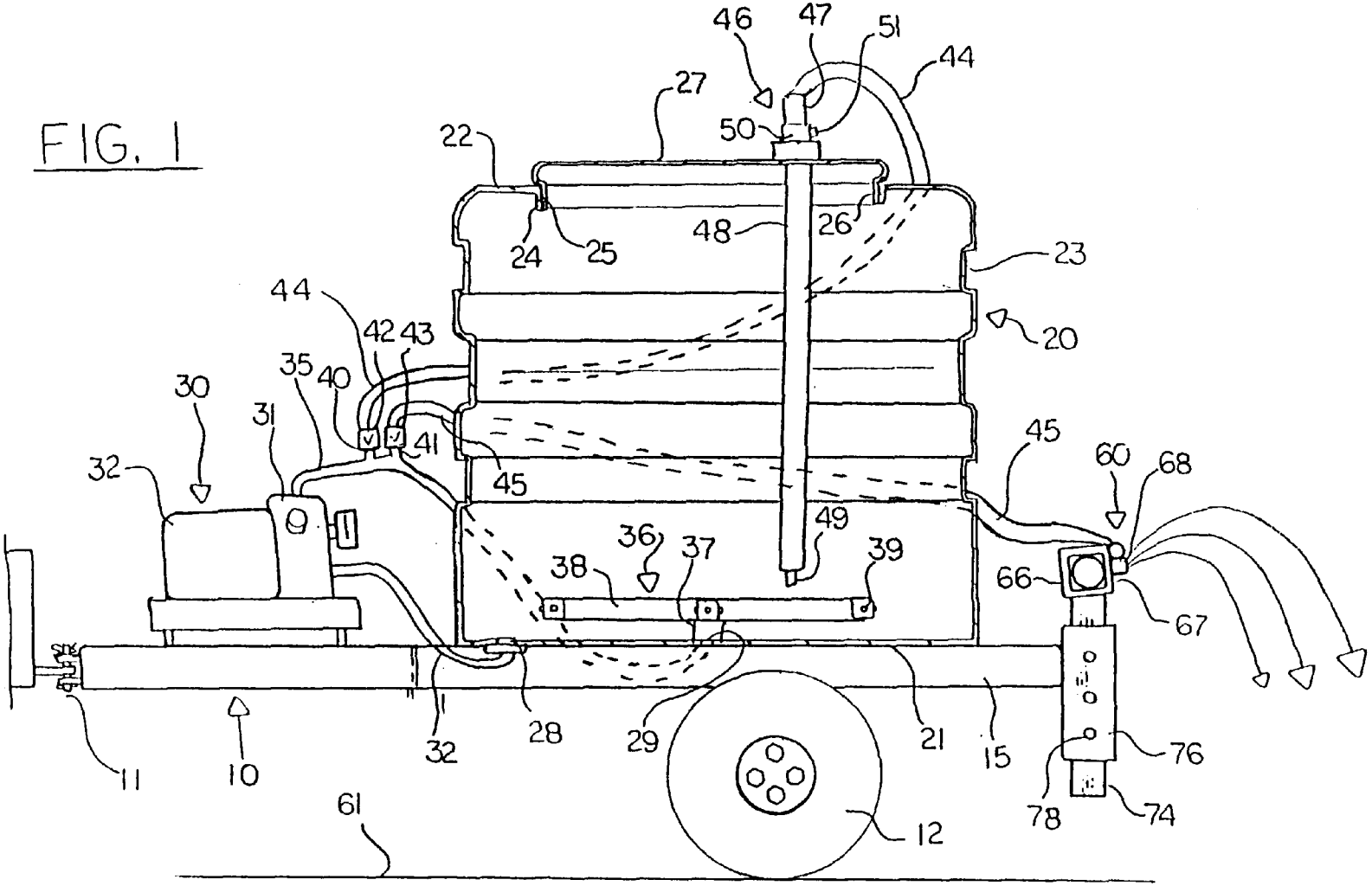
FIG. 1 is a side elevational view of an apparatus according to the present invention.
Figure 2:
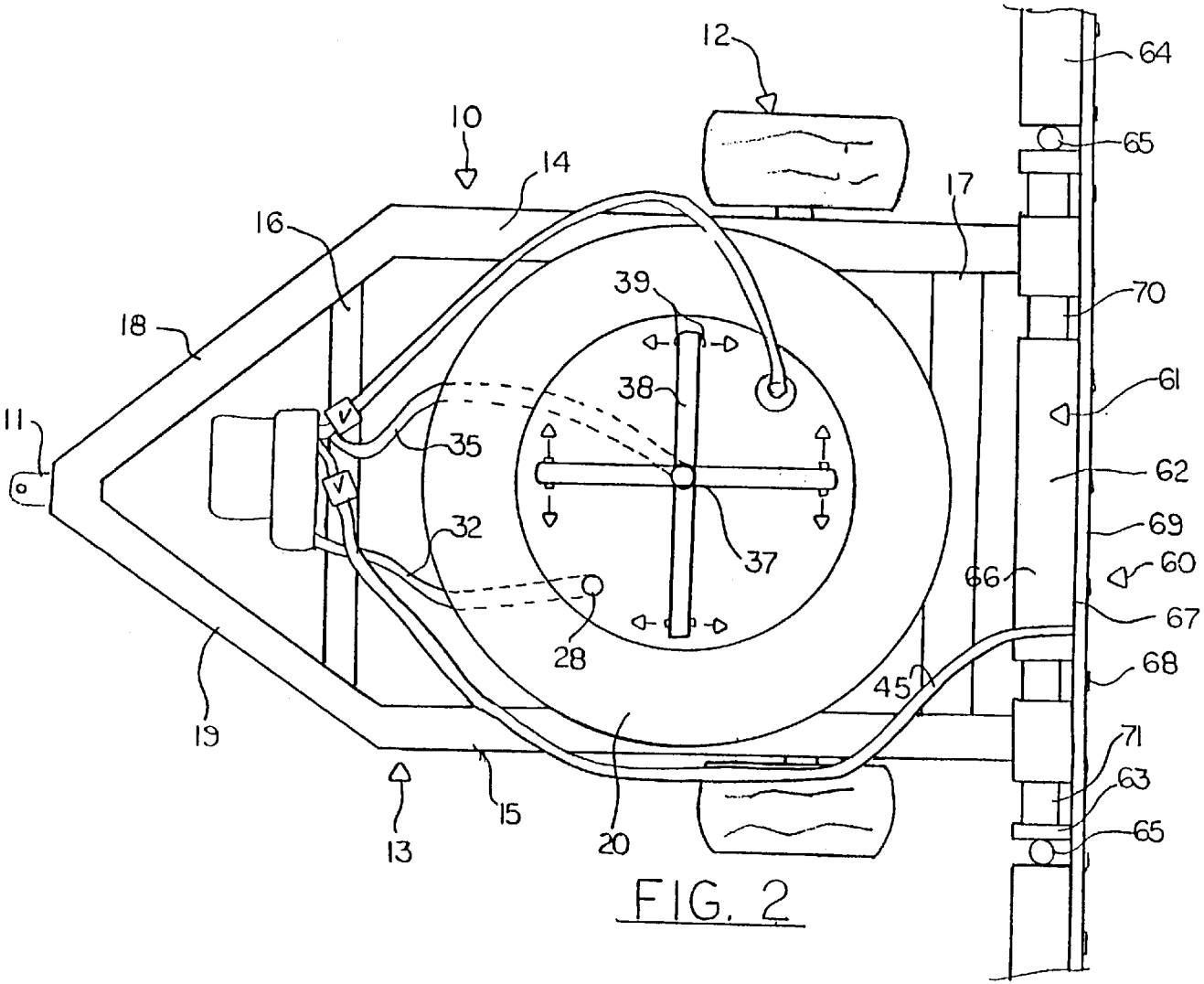
FIG. 2 is a top plan view of the apparatus of FIG. 1.

The apparatus as shown in the figures comprises a trailer 10 having a hitch 11 and ground wheels 12 so that the trailer can be towed across the ice by a suitable towing vehicle. The trailer further includes a frame 13 having a pair of side rails 14 and 15 interconnected by transverse beams 16 and 17 and attached to the hitch by inwardly converging hitch arms 18 and 19.

On top of the frame is mounted a tank 20 which is suitably attached to the frame for support thereby. The tank is cylindrical with a flat bottom wall 21 of a substantially flat top wall 22. The cylindrical peripheral wall has a series of stiffening bands 23. The top wall 22 has an opening 24 having a female screw thread 25 for receiving the male screw thread 26 of a circular cover panel 27. The cover panel can therefore be removed to allow access to the interior of the tank and can be screwed into place to provide a closed and substantially sealed container. The opening 24 covers a large proportion of the top of the tank so that the diameter of the opening is at least of the order of eighteen inches so as to allow ready access to the interior and to allow easy and rapid discharge of powder material from 20 kilogram bags into the interior of the container.

The bottom wall 21 has a discharge opening 28 and a return opening 29. The return opening 29 is located at the center of the bottom wall. The discharge opening is located in any suitable position and preferably the tank is shaped so that it slopes to the discharge opening to allow discharge of the complete contents of the tank without pooling.

In front of the tank 20 on the frame is mounted a pump having a pump body 31 and a suitable power supply schematically indicated at 32. The pump can be driven by any suitable power source including electric supply from the towing vehicle or a separate internal combustion engine.

An inlet line 32 communicates from the discharge opening 28 of the tank to the inlet port of the pump body.

The pump is selected as a high pressure high volume pump relative to the quantity of liquid so that the pump has a significantly higher capacity than that which would normally be associated with a tank of this size. Thus the tank has a capacity of the order of 100 gallons and the pump has a capacity of 100 gallons per minute at 70 PSI. It will be appreciated that a pump of this capacity can therefore recirculate the material from the tank back to the tank so that the whole capacity of the tank is recirculated in one minute and it will be appreciated in this capacity significantly greater than the amount of material which is necessary to spray from the tank since the tank would otherwise be emptied within one minute.

An outlet of the pump is connected to an outlet line 35 which returns to the inlet opening 29 and is coupled to the inlet opening 29 for returning the liquid withdrawn from the discharge opening 28 back into the tank. Suitable plumbing connections are provided at the inlet and outlet openings as it will be well known to one skilled in the art.

At the outlet opening 29 is mounted a jet return mixing assembly generally indicated at 36. The mixing assembly 36 comprises a central hub 37 and four radial extending arms 38 arranged in a common horizontal plane and extending outwardly from the hub to a position partway across the bottom wall toward the side wall of the tank. The ends of the arms are thus spaced inwardly from the peripheral wall of the tank. Each arm has a pair of jet nozzles 39 arranged on a respective side of the arm. Thus the jet nozzles are arranged again in the common horizontal plane and a jet angularly around the tank.

The openings 28 and 29, the lines 32 and 35, the tubular arms 38 and the nozzles 39 are arranged to accommodate the flow rate of the pump so that the amount of flow through this recirculating system is approximately equal to the capacity of the pump which is of the order of the capacity of the tank per minute.

The line 35 has two T couplings 40 and 41 each communicating with a respective valve 42, 43. The valves 42 and 43 control flow of the mixed liquid from the line 35 into two supply lines 44 and 45. The valves can be operated so that one is open while the other is closed. Two separate valves are shown in the schematic illustration but it will be appreciated that a single valve may be provided which allows three positions wherein the first position closes to supply to both lines 44 and 45, the second position provides supply to the line 44 and the third position supply the line 45.

The line 44 comprises a flexible hose which is draped around the tank to an upper end of a wand 46. The wand 46 includes a handle 47 and an elongate rigid tubular wand portion 48. At the end of the wand portion is a jet nozzle 49. A valve 50 controls the supply of the liquid from the pump to the jet nozzle 49 and can be actuated by a manual press button 51 at the handle 47.

The wand 46 has a receptacle in which it can be normally stored and this receptacle can be a separate scabbard alongside the tank or it can be simply a hole in the cover 27 allowing the wand portion to be inserted through the opening in the cover and thus maintained in the stored position within the tank.

The wand is used in an initial mixing process for mixing paint and water within the tank. In the mixing process an initial quantity of water is inserted into the bottom of the tank from a suitable water supply. (not shown) Subsequently bags of paint or pigment are opened and the contents poured into the tank to join with the water. The paint is supplied in powder form for dissolving into the water. Very approximately in one example, with the capacity of 100 gallons, the amount of the powdered pigment is roughly one half of the quantity with the water being the other half of the quantity.

With a quantity of water in the tank, the pump is actuated so that the recirculation system commences. Pigment is then inserted by pouring through the opening into the water and the jet return mixing system 36 commences a mixing action. In order to assist the initial mixing action, the wand is used to stir the powder into the water and to break up any collections of powder which are interfering with the circulation of the water and thus improperly mixing. The wand is actuated manually by the operator looking into the tank to observe the mixing action so that the operator can move the wand to the required positions to break up the collections and to assist in the stirring action. The wand therefore works by physically moving the powder using the wand portion 48 and by jetting liquid into the powder from the nozzle 49.

When the mixing action is complete, the valve 40 is actuated to close off supply to the wand, the cover 27 is replaced and the wand is stored in its storage location.

The line 45 supplies a boom 60 for spraying the mixed materials from the tank onto the ice surface 61.

The boom 60 comprises a main horizontal beam 61 which extends across the width to be sprayed. The beam 61 includes a center section 62, a first wing section 63 and a second wing section 64. The wing section 63 and 64 are each pivotal relative to the centre section about a pivot member 65 which acts to hold the wing sections normally aligned with the center section along the common horizontal line but also allows the wing sections to pivot rearwardly in the event of accidental impact with an obstacle and also to pivot forwardly when manually moved from the operating position to a folded position lying alongside the tank for transportation. The pivot mounting 65 is shown only schematically as its construction will be well known to one skilled in the art and can vary in accordance with design requirements.

Each section of the boom comprises a square tube 66 which provides a mounting face 67 for receiving a plurality of nozzles 68. The nozzle 68 are supplied by a line 69 extending across the nozzles in front of the face 67 with the line 69 being connected to the supply line 45 at a suitable location along its length. As the sprayer is relatively narrow, having a width of the boom in one example of the order of 12 feet, there is no necessity to balance the flow to the individual nozzles and a single supply line is sufficient to provide the required consistency of flow.

The tubular beams 66 are attached to intermediate circular neck portions 70 and 71 positioned adjacent the ends of the center section 62. The neck sections are received in a pair of collars 72 and 73 each forming a cylindrical sleeve surrounding the next section and allowing rotation of the beam forming the boom about its axis so as to vary the angular position of the nozzles around the axis. This adjustment is effected manually and the frictional engagement between the collars 72, 73 and the next section 70, 71 holds the boom at the required angle.

As shown in FIG. 1, the boom is rotated to a position in which the nozzles project substantially horizontally rearwardly and preferably slightly upwardly. This is contrary to conventional sprayer systems where the spray is directed primarily downwardly and sometimes downwardly and forwardly. This angle is selected so that the nozzles can use a very fine mist and allowing the mist to be sprayed rearwardly and then fall by gravity to the ice surface so that the mist reaches the ice surface with little momentum causing it sit directly on the ice surface and freeze rapidly to the ice surface. Rapid freezing of the water and pigment droplets causes the freezing to occur with little or no absorption of oxygen so that the water remains transparent allowing the pigment to be visible.

Figure 3:
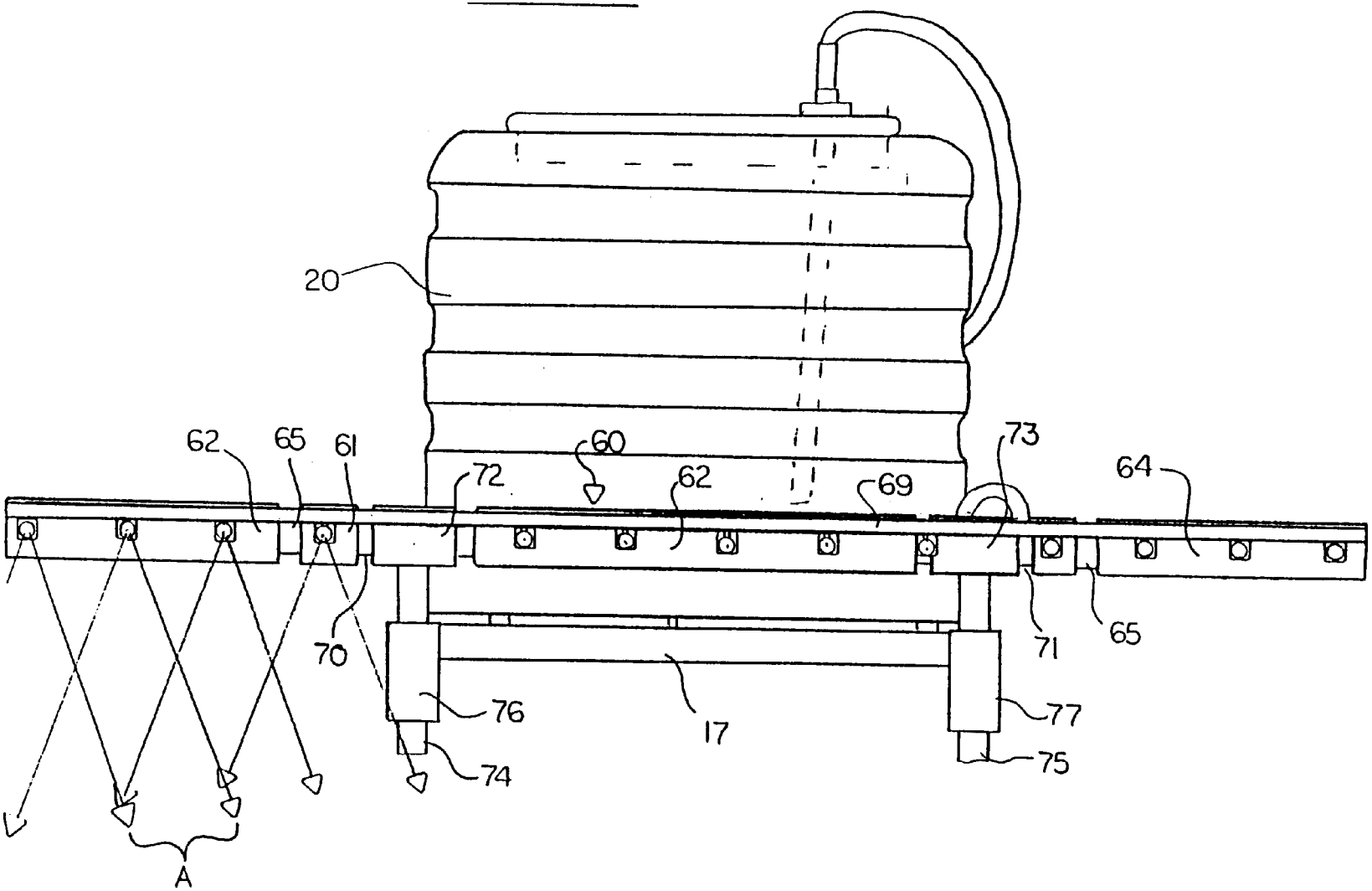
FIG. 3 is a rear elevational view of the apparatus of FIG. 1.

In addition as shown in FIG. 3, the spacing of the nozzles is arranged relative to the height of the boom from the ground and the angle of the spray jet of the nozzle so that the jets overlap as indicated in the zone A. Preferably the amount of overlap is arranged so that there is substantially wholly over the full area a double coating. Thus the width of the spray pattern at the ice surface is substantially equal to twice the spacing between the nozzles. Again this double spray coating allows the use of smaller droplets to generate a finer mist which freezes more quickly.

The collars 72 and 73 are mounted on respective ones of a pair of posts 74 and 75 each of which is carried in a respective vertical collar 76, 77 attached to the rear end of the side rail 14 and 15 of the frame. The collars 76 and 77 provide a plurality of adjustment holes 78 allowing the height of the posts 74 and 75 and therefore the boom to be adjusted relative to the frame.

As previously explained, when the valve 43 is open so that mixed materials are fed to the boom, the remainder of the materials pumped through the pump are returned through the jet mixing return system 36 into the tank so as to maintain the necessary mixture within the tank. The vast majority of the material pumped are returned in this way and in only a small proportion passes through the nozzles for spraying to the ice surface. A filled tank of 100 gallons is generally sufficient to provide a single coat on an ice rink surface. Subsequent coats are generally applied to obtain the necessary depth and thickness of pigment including a second coat of the same material and a third coat of a sealer.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. Apparatus for painting an ice surface of a rink comprising:

a support frame arranged for transportation across the ice surface;

a tank mounted on the frame having an opening at a top wall for insertion of paint and water for mixture in the tank and a discharge opening at a bottom wall for extraction of mixed materials from the tank;

a pump having an inlet lying connected to the discharge opening for pumping the mixed materials;

a boom mounted on the frame transversely of the frame;

a plurality of spray nozzles mounted on the boom at spaced positions along the boom;

a pipe connected from an outlet of the pump to the spray nozzles for supplying the mixed materials to the spray nozzles;

an injection mixing return connected from an outlet opening of the pump for injecting mixed materials into the tank and arranged for remixing of the materials in the tank;

the injection mixing return including a plurality of jet nozzles arranged adjacent the bottom wall of the tank at angularly spaced positions around a central location of the bottom wall of the tank, the nozzles being directed so as to inject the mixed materials angularly around the bottom wall in a swirling action;

wherein the pump generates a pumped volume greater than that which can pass in total through the nozzles and wherein the excess mixed materials pumped by the pump is returned to the tank through the injection mixing return to maintain the materials mixed by the swirling action during spraying.

2. The apparatus according to claim 1 wherein the nozzle capacity is small relative to the pumped volume of the pump so that the majority of the mixed materials is returned to the tank.

3. The apparatus according to claim 1 wherein the pumped volume of the pump is arranged so that it can pump per minute a volume approximately equal to the volume of the tank.

4. The apparatus according to claim 1 wherein the injection mixing return comprises a plurality of arms extending from a return hub across the bottom wall of the tank each arm having a respective one of the jet nozzles thereon at an end thereof and generally at right angles thereto.

5. The apparatus according to claim 1 wherein there is provided a mixing wand for insertion into the tank through the opening, the wand having a pipe connected to the pump for receiving the mixed materials therefrom and a jet nozzle at a remote end of the wand and wherein there is provided a valve arrangement operable to control flow of mixed materials either to the boom or to the wand, the wand having a length so as to extend from the opening to a position adjacent a bottom of the tank such that the wand can be used prior to spraying to effect stirring and mixing of the materials in the tank.

6. The apparatus according to claim 5 wherein there is provided on the tank a receptacle for receiving and storing the wand.

7. The apparatus according to claim 1 wherein the nozzles are arranged with an angle of spray relative to a spacing between the nozzles and relative to a distance travelled by the spray from the nozzles to the ice surface such that the spray from each nozzle overlaps with the spray from each next adjacent nozzle sufficiently to provide double coverage across the full width of the boom.

8. The apparatus according to claim 1 wherein the boom is arranged such that the nozzles are arranged to generate a spray which is directed substantially horizontally such that the spray from the nozzles falls by gravity only onto the ice surface.

9. The apparatus according to claim 8 wherein the nozzles are arranged to generate the spray which is directed slightly upwardly from horizontal.

10. Apparatus for painting an ice surface of a rink comprising:

a support frame arranged for transportation across the ice surface;

a tank mounted on the frame having an opening at a top wall for insertion of paint and water for mixture in the tank and a discharge opening at a bottom wall for extraction of mixed materials from the tank;

a pump having an inlet lying connected to the discharge opening for pumping the mixed materials;

a boom mounted on the frame transversely of the frame;

a plurality of spray nozzles mounted on the boom at spaced positions along the boom;

a pipe connected from an outlet of the pump to the spray nozzles for supplying the mixed materials to the spray nozzles;

an injection mixing return connected from an outlet opening of the pump for injecting mixed materials into the tank and arranged for remixing of the materials in the tank;

and a mixing wand for insertion into the tank through the opening, the wand having a pipe connected to the pump for receiving the mixed materials therefrom and a jet nozzle at a remote end of the wand and wherein there is provided a valve arrangement operable to control flow of mixed materials either to the boom or to the wand, the wand having a length so as to extend from the opening to a position adjacent a bottom of the tank such that the wand can be used prior to spraying to effect stirring and mixing of the materials in the tank.

11. The apparatus according to claim 10 wherein there is provided on the tank a receptacle for receiving and storing the wand.

12. Apparatus for painting an ice surface of a rink comprising:

a support frame arranged for transportation across the ice surface;

a tank mounted on the frame having an opening at a top wall for insertion of paint and water for mixture in the tank and a discharge opening at a bottom wall for extraction of mixed materials from the tank;

a pump having an inlet lying connected to the discharge opening for pumping the mixed materials;

a boom mounted on the frame transversely of the frame;

a plurality of spray nozzles mounted on the boom at spaced positions along the boom;

a pipe connected from an outlet of the pump to the spray nozzles for supplying the mixed materials to the spray nozzles;

wherein the nozzles are arranged with an angle of spray relative to a spacing between the nozzles and relative to a distance travelled by the spray from the nozzles to the ice surface such that the spray from each nozzle overlaps with the spray from each next adjacent nozzle sufficiently to provide double coverage across the full width of the boom; and wherein the boom is arranged such that the nozzles are arranged to generate a spray which is directed substantially horizontally such that the spray falls from the nozzles by gravity only onto the ice surface.

13. The apparatus according to claim 12 wherein the nozzles are arranged to generate the spray which is directed slightly upwardly from horizontal.

* * * * *